US010123568B1

(12) United States Patent
Zhu

(10) Patent No.: US 10,123,568 B1
(45) Date of Patent: Nov. 13, 2018

(54) VAPORIZERS HAVING MULTIPLE HEATING ELEMENTS AND ELECTRONIC CIGARETTES HAVING THE SAME

(71) Applicant: SHENZHEN KANGER TECHNOLOGY CO., LTD., Shenzhen (CN)

(72) Inventor: Xiaochun Zhu, Shenzhen (CN)

(73) Assignee: SHENZHEN KANGER TECHNOLOGY CO., LTD., Shenzhen (CN)

( * ) Notice: Subject to any disclaimer, the term of this patent is extended or adjusted under 35 U.S.C. 154(b) by 22 days.

(21) Appl. No.: 15/596,669

(22) Filed: May 16, 2017

(30) Foreign Application Priority Data

May 15, 2017 (CN) ..... 2017 1 0338775

(51) Int. Cl.
*A24F 11/00* (2006.01)
*A24F 47/00* (2006.01)
*B65D 43/02* (2006.01)

(52) U.S. Cl.
CPC ..... *A24F 47/008* (2013.01); *B65D 43/02* (2013.01)

(58) Field of Classification Search
CPC ..... A24F 47/008; A24F 47/002
USPC ..... 131/328, 329
See application file for complete search history.

(56) References Cited

U.S. PATENT DOCUMENTS

2012/0260927 A1* 10/2012 Liu ..... A24F 47/008 131/329
2014/0060556 A1* 3/2014 Liu ..... A24F 47/008 131/329
2014/0366898 A1* 12/2014 Monsees ..... A24F 47/008 131/329
2015/0059787 A1* 3/2015 Qiu ..... A24F 47/008 131/329
2015/0245661 A1* 9/2015 Milin ..... A24F 47/008 131/329
2015/0374039 A1* 12/2015 Zhu ..... A24F 47/008 131/329
2016/0000146 A1* 1/2016 Zhu ..... A24F 47/008 392/404
2016/0106153 A1* 4/2016 Zhu ..... A24F 47/008 131/329

(Continued)

*Primary Examiner* — Hae Moon Hyeon
(74) *Attorney, Agent, or Firm* — Ming Jiang; MM IP Services LLC

(57) ABSTRACT

Present disclosure relates to a vaporizer assembly having multiple heating elements, and electronic cigarettes having the vaporizer assembly with multiple heating elements. In certain embodiments, the vaporizer assembly includes a heating element assembly. The heating element assembly includes an E-liquid storage tank internal wall defining multiple E-liquid openings to allow an external E-liquid storage medium and an internal E-liquid storage medium to receive E-liquid from an E-liquid storage tank. The heating element assembly also includes multiple heating elements. These heating elements are in direct contact with surface of the internal E-liquid storage medium to heat the E-liquid received from the E-liquid storage tank. When a user uses the electronic cigarette with multiple heating elements, the user turns on one or more of the heating elements to adjust the vaporization of the E-liquid. When all heating elements are in use, the electronic cigarette generates great amount E-liquid vapor.

20 Claims, 7 Drawing Sheets

(56) References Cited

U.S. PATENT DOCUMENTS

| | | | | |
|---|---|---|---|---|
| 2016/0135505 | A1* | 5/2016 | Li | H05B 3/44<br>131/329 |
| 2016/0278436 | A1* | 9/2016 | Verleur | A24F 47/008 |
| 2017/0105454 | A1* | 4/2017 | Li | H05B 1/0244 |

* cited by examiner

VAPORIZERS HAVING MULTIPLE HEATING ELEMENTS AND ELECTRONIC CIGARETTES HAVING THE SAME

FIELD

The present disclosure generally relates to the field of electronic cigarette, and more particularly to vaporizers having multiple heating elements, electronic cigarettes having the vaporizers with multiple heating elements, and methods of using the electronic cigarettes having the vaporizers with multiple heating elements.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

It is well known that smoking cigarette is harmful to smoker's health. The active ingredient in a cigarette is mainly nicotine. During smoking, nicotine, along with tar aerosol droplets produced in the cigarette burning, are breathed into the alveolus and absorbed quickly by the smoker. Once nicotine is absorbed into the blood of the smoker, nicotine then produces its effect on the receptors of the smoker's central nervous system, causing the smoker relax and enjoy an inebriety similar to that produced by an exhilarant.

The electronic cigarette is sometimes referred as electronic vaporing device, personal vaporizer (PV), or electronic nicotine delivery system (ENDS). It is a battery-powered device which simulates tobacco smoking. It generally uses a heating element that vaporizes a liquid solution (e-liquid). Some solutions contain a mixture of nicotine and a variety of flavorings, while others release a flavored vapor without nicotine. Many are designed to simulate smoking experience, such as cigarette smoking or cigar smoking. Some of them are made with similar appearance, while others are made considerably different in appearance.

Conventional electronic cigarettes have one heating elements, and the heating element provides only limited amount of E-liquid vapor. For certain electronic cigarette smoker, it is desirable that the electronic cigarette has an ability to generate more E-liquid vapor and an ability to control the amount of vapor the electronic cigarette generates.

Therefore, an unaddressed need exists in the art to address the aforementioned deficiencies and inadequacies.

SUMMARY

In one aspect, the present disclosure relates to a vaporizer assembly. In certain embodiments, the vaporizer assembly includes a heating element assembly. The heating element assembly includes an E-liquid storage tank internal wall defining multiple E-liquid openings to allow an external E-liquid storage medium and an internal E-liquid storage medium to receive E-liquid from an E-liquid storage tank. The heating element assembly may also include multiple heating elements. These heating elements are in direct contact with surface of the internal E-liquid storage medium to heat the E-liquid received from the E-liquid storage tank.

A user of an electronic cigarette may switch on one or more of the heating elements to adjust the vaporization of the E-liquid.

In another aspect, the present disclosure relates to an electronic cigarette. In certain embodiments, the electronic cigarette includes a vaporizer assembly having a heating element assembly. The heating element assembly includes: an E-liquid storage tank internal wall defining multiple E-liquid openings to allow an external E-liquid storage medium and an internal E-liquid storage medium to receive E-liquid from an E-liquid storage tank. The heating element assembly may also include multiple heating elements. These heating elements are in direct contact with surface of the internal E-liquid storage medium to heat the E-liquid received from the E-liquid storage tank. A user of the electronic cigarette may switch on one or more of the heating elements to adjust the vaporization of the E-liquid.

In yet another aspect, the present disclosure relates to a method of using an electronic cigarette having a vaporizer assembly with multiple heating elements. In certain embodiments, the method includes: pressing, by a user, one or more push button switches to turn on an electrical power supply to one or more heating elements according to the desired amount vapor the user wishes to have, one push button switch corresponds to one heating element, and sucking, by the user, E-liquid vapor from the vaporizer assembly through a mouthpiece. Air outside of the electronic cigarette enters the vaporizer assembly through an air intake adjustment ring defining a first air intake opening and a second air intake opening that coincide a first air chamber opening and a second air chamber opening on an air chamber body, respectively, and vapor formed by the vaporizer assembly exits through the mouthpiece.

These and other aspects of the present disclosure will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and, together with the written description, serve to explain the principles of the disclosure. Wherever possible, the same reference numbers are used throughout the drawings to refer to the same or like elements of an embodiment. The drawings do not limit the present disclosure to the specific embodiments disclosed and described herein. The drawings are not necessarily to scale, emphasis instead being placed upon clearly illustrating the principles of the disclosure, and wherein.

DETAILED DESCRIPTION

Figure 1:
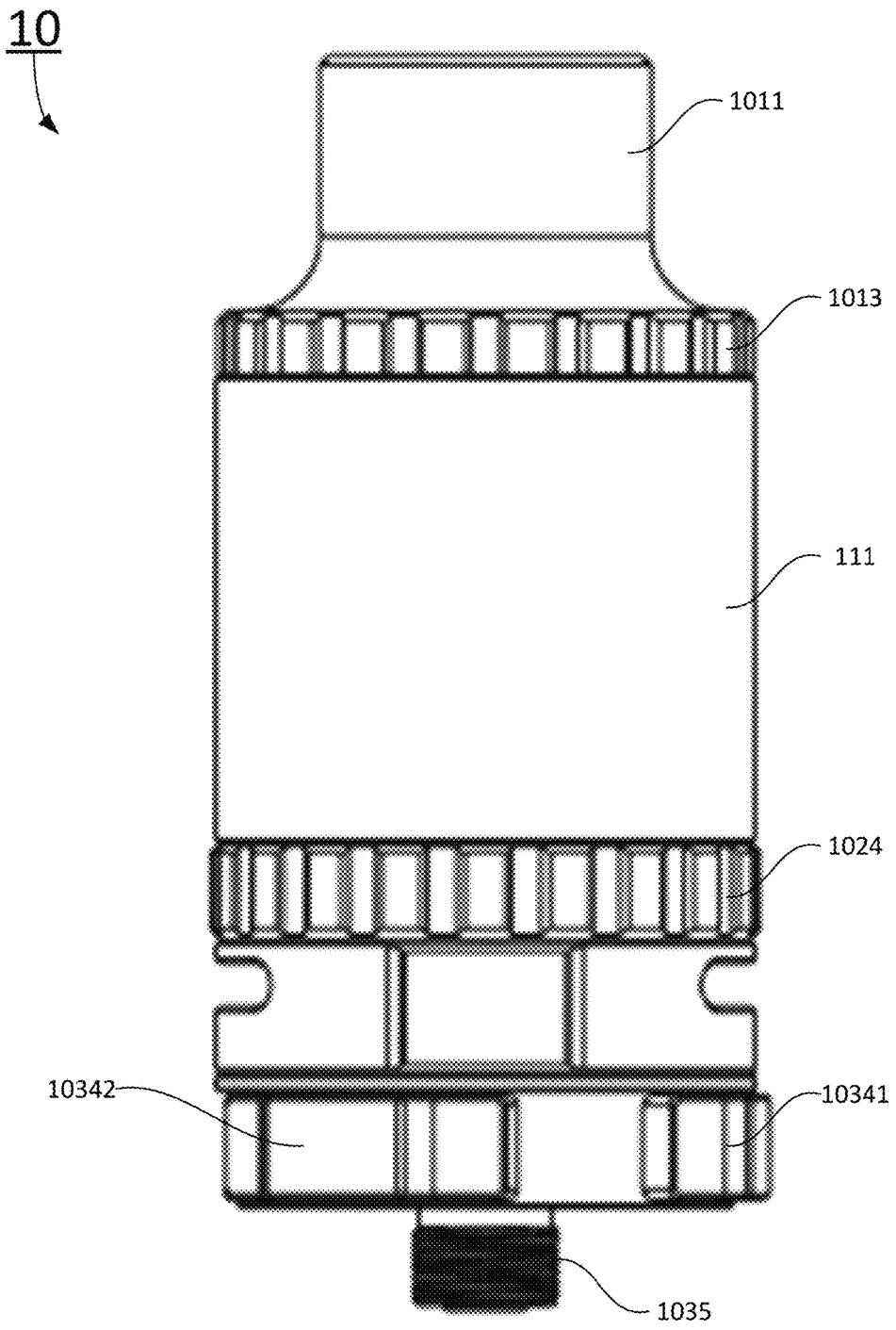
FIG. 1 is an external view of an exemplary electronic cigarette having multiple heating elements according to certain embodiments of the present disclosure.

The present disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present disclosure be fully understood, but the present disclosure may also be implemented by using other manners different from those described herein, so that the present disclosure is not limited by the specific embodiments disclosed in the following.

The description will be made as to the embodiments of the present disclosure in conjunction with the accompanying drawings FIGS. 1 through 7.

Figure 2:
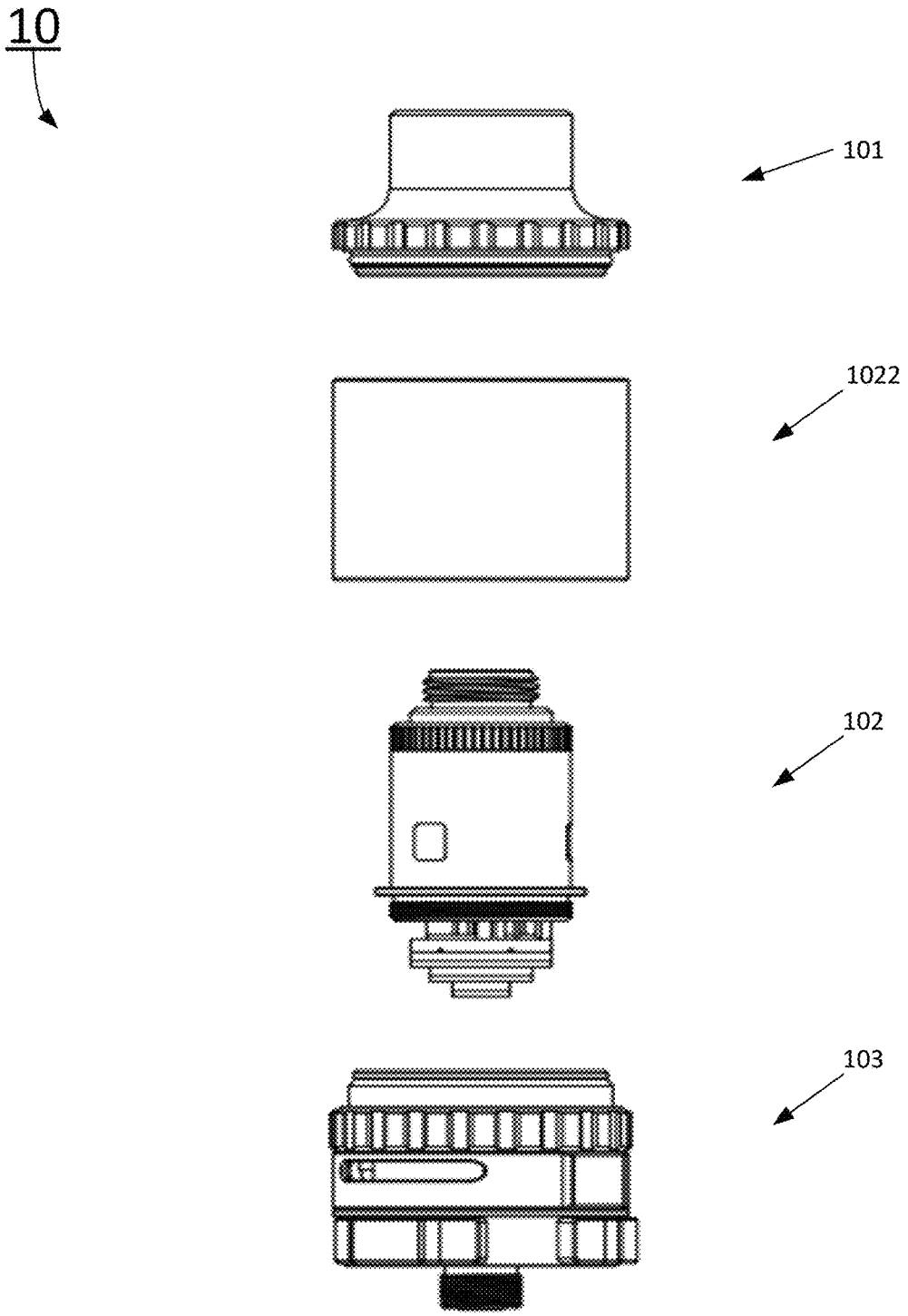
FIG. 2 is an exploded view of the exemplary electronic cigarette showing major components according to certain embodiments of the present disclosure.

Referring now to FIGS. 1-2, an external view and an exploded view of an exemplary electronic cigarette 10 are shown respectively according to certain embodiments of the present disclosure.

Figure 4:
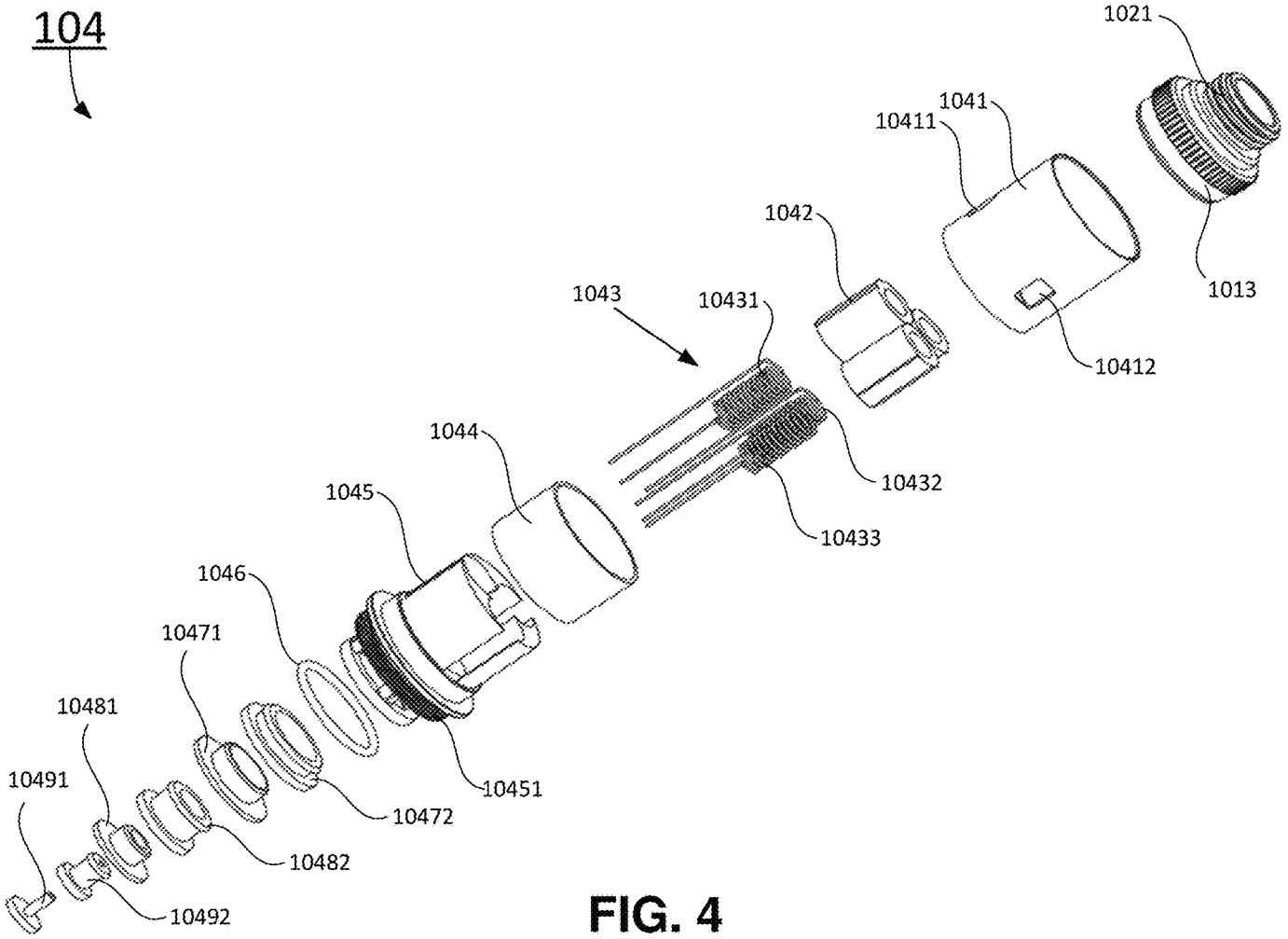
FIG. 4 is an exploded perspective view of a vaporizer with multiple heating elements according to certain embodiments of the present disclosure.

In one aspect, the present disclosure relates to a vaporizer assembly 102. In certain embodiments, the vaporizer assembly 102 includes a heating element assembly 104. The heating element assembly 104 includes an E-liquid storage tank internal wall 1041 defining multiple E-liquid openings. In an exemplary embodiment as shown in FIG. 4, the E-liquid storage tank internal wall 1041 defines a first E-liquid opening 10411, a second E-liquid opening 10412, and a third E-liquid opening 10413. These E-liquid openings allow an external E-liquid storage medium 1044 positioned inside of the E-liquid storage tank internal wall 1041, and an internal E-liquid storage medium 1042 positioned inside of the external E-liquid storage medium 1044 to receive E-liquid from an E-liquid storage tank 111. In certain embodiments, the vaporizer assembly 102 includes an E-liquid storage tank external wall 1022. The E-liquid storage tank external wall 1022 and the E-liquid storage tank internal wall 1041 may be made of steel, aluminum, stainless steel, or other metal materials. The E-liquid storage tank external wall 1022 may be made of glass or any transparent plastic, acrylic materials so the user may see how much E-liquid is inside the E-liquid storage tank 111.

Figure 6:
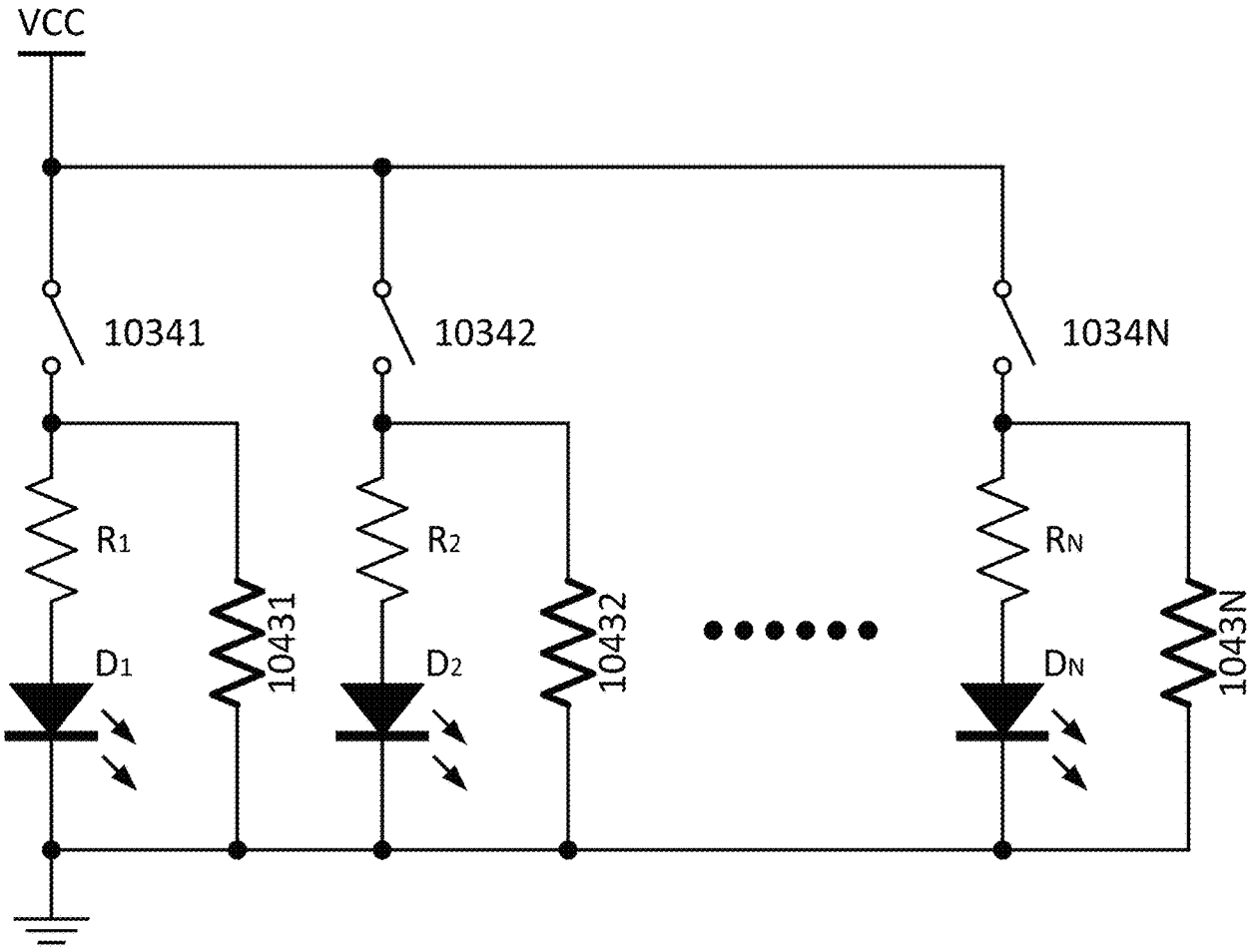
FIG. 6 is a circuit diagram of the exemplary electronic cigarette according to certain embodiments of the present disclosure.

The heating element assembly 104 may also include multiple heating elements 1043. In one embodiment, the heating element assembly 104 may include N heating elements 1043, as shown in FIG. 6. In an exemplary embodiment shown in FIG. 4, the multiple heating elements 1043 include a first heating element 10431, a second heating element 10432, and a third heating element 10433. These heating elements 1043 are in direct contact with surface of the internal E-liquid storage medium 1042 to heat the E-liquid received from the E-liquid storage tank 111. Each of the first heating element 10431, the second heating element 10432, and the third heating element 10433 can be turned on by a user of the electronic cigarette 10 individually. The user may switch on one or more of the heating elements 1043 to adjust the vaporization of the E-liquid by the vaporizer assembly 102.

In certain embodiments, the E-liquid storage tank 111 is installed outside of the vaporizer assembly 102. The E-liquid storage tank 111 includes: an E-liquid storage tank top cover 1013 on the top end of the E-liquid storage tank 111, the E-liquid storage tank internal wall 1041 from the inside of the E-liquid storage tank 111, an E-liquid storage tank external wall 1022 forming the outside of the E-liquid storage tank 111, and a vaporizer assembly mounting base 1024 at the bottom of the E-liquid storage tank 111. The E-liquid storage tank 111 is sealed by a first mouthpiece sealing ring 1014 on the top and a vaporizer sealing ring 1023 at the bottom.

In certain embodiments, these heating elements 1043 may be made with one or more of: aluminum (Al), Chromium (Cr), Manganese (Mn), Iron (Fe), Cobalt (Co), Nickel (Ni), Copper (Cu), Zirconium (Zr), Niobium (Nb), Molybdenur (Mo), Rhenium (Re), Silver (Ag), Cadmium (Cd), Tantalum (Ta), Tungsten (W), Iridium (Ir), Platinum (Pt), Gold (Au), and alloys of these materials.

In certain embodiments, each of the heating elements 1043 may include: a grid shaped heating element, a mesh shaped heating element, a net shaped heating element, a spiral heating element, and any combination of these shapes. The internal E-liquid storage medium 1042 are made to accommodate the specific shapes of the heating elements 1043. In one embodiment, as shown in FIG. 4, the heating element assembly 104 includes a first heating element 10431, a second heating element 10432, and a third heating element 10433. Each of the first heating element 10431, the second heating element 10432, and the third heating element 10433 is in a cylindrical shape. The internal E-liquid storage medium 1042 includes three cylindrical shaped E-liquid storage media to match the shapes of the heating elements. The heating element base 1045 are also made to accommodate the specific shapes of the internal E-liquid storage medium 1042.

Each of the external E-liquid storage medium 1044 and the internal E-liquid storage medium 1042 includes: cotton fibers, polypropylene fibers, terylene fibers, nylon fibers, and porous ceramic materials.

In another aspect, the present disclosure relates to an electronic cigarette 10. In certain embodiments, the electronic cigarette 10 includes a mouthpiece assembly 101, an E-liquid storage tank 111, a vaporizer assembly 102, and an electronic cigarette base assembly 103, as shown in FIGS. 1-5.

Figure 3:
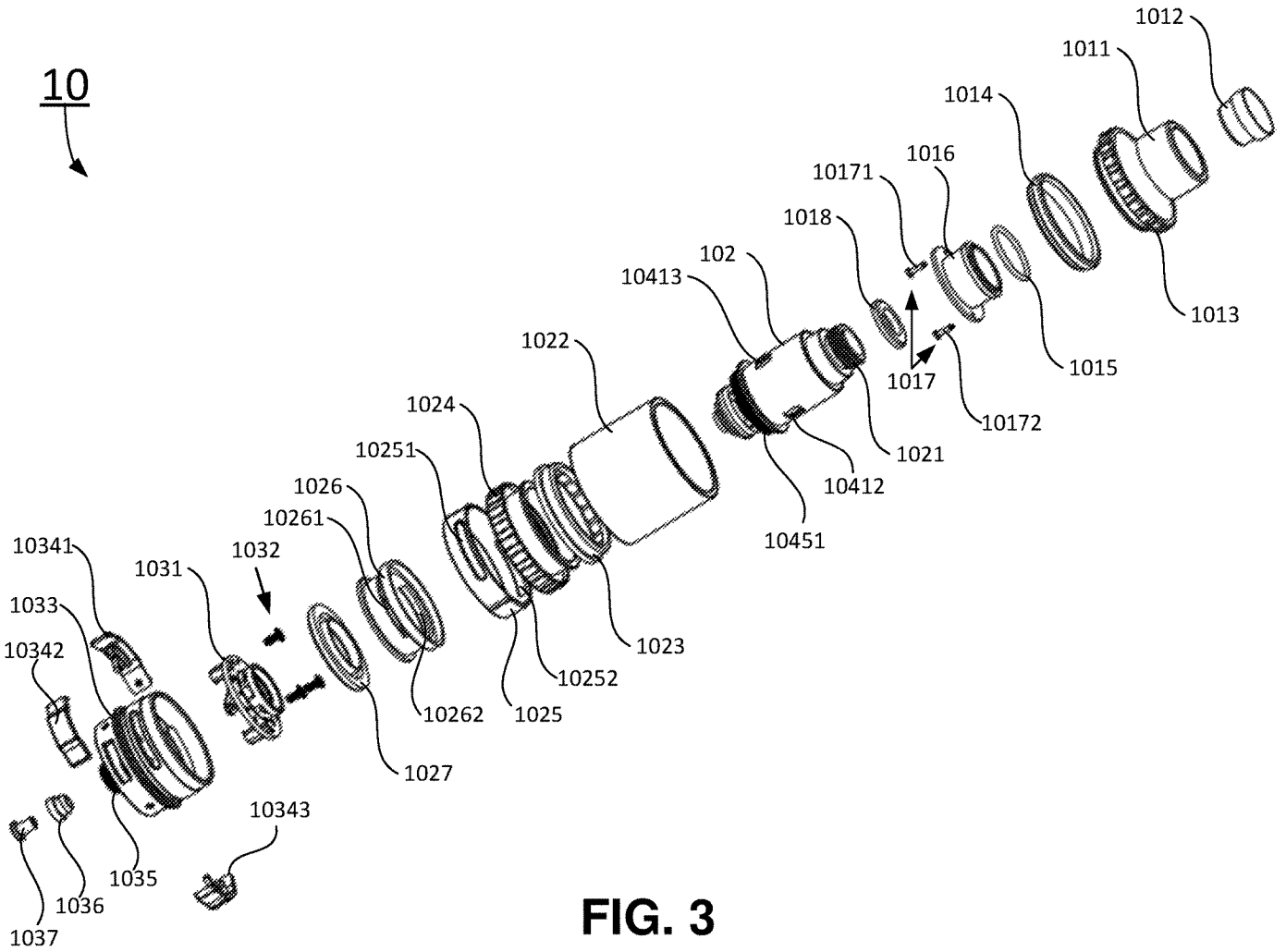
FIG. 3 is an exploded perspective view of the exemplary electronic cigarette showing components in detail according to certain embodiments of the present disclosure.

In certain embodiments, the mouthpiece assembly 101 has a mouthpiece 1011, a mouthpiece fastener 1012, an E-liquid storage tank top cover 1013, a threaded mouthpiece mounting ring 1016. The mouthpiece 1011 is used by the user to enjoy vaporized E-liquid. The mouthpiece fastener 1012 positioned coaxially inside the mouthpiece 1011 to form an internal vapor pathway. The threaded mouthpiece mounting ring 1016 has internal threads to mount the mouthpiece assembly 101 on the vaporizer assembly 102 through external mouthpiece mounting threads 1021 of the vaporizer assembly 102. The mouthpiece assembly 101 also includes several mouthpiece mounting ring fasteners 1017. In one embodiment as shown in FIG. 3, the mouthpiece mounting ring fasteners 1017 include a first mouthpiece mounting ring fastener 10171, and a second mouthpiece mounting ring fastener 10172. They are usually evenly distributed on a lower edge of the threaded mouthpiece mounting ring 1016 to attach the threaded mouthpiece mounting ring 1016 to the mouthpiece 1011.

Figure 5:
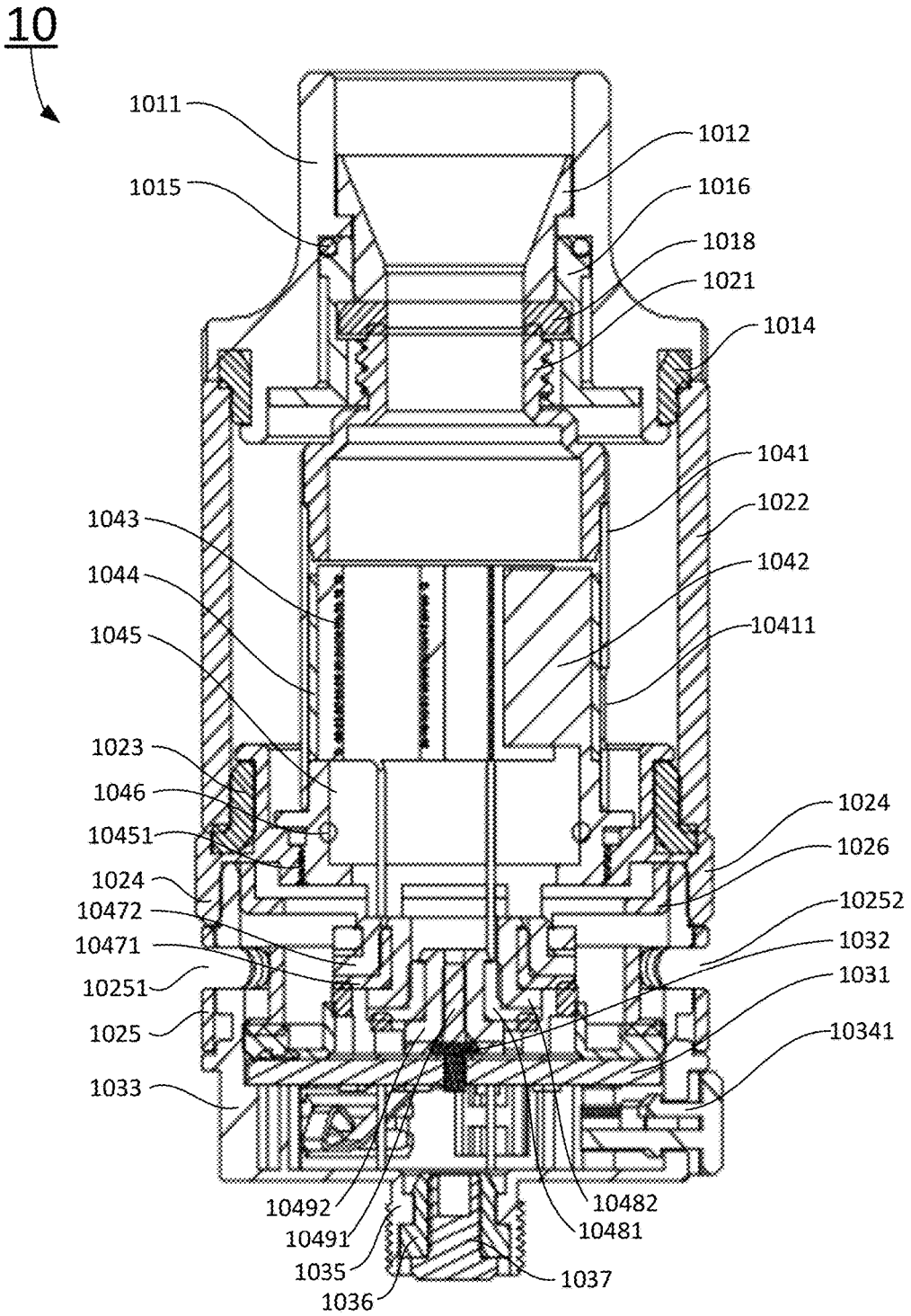
FIG. 5 is a sectional view of the exemplary electronic cigarette according to certain embodiments of the present disclosure.

In an exemplary embodiment as shown in FIG. 5, the mouthpiece assembly 101 has a first mouthpiece sealing ring 1014, a second mouthpiece sealing ring 1015, and a third mouthpiece sealing ring 1018. The first mouthpiece sealing ring 1014 seals the top end of the E-liquid storage tank 111. The second mouthpiece sealing ring 1015 blocks vapor passage between the mouthpiece 1011 and the threaded mouthpiece mounting ring 1016. The third mouthpiece sealing ring 1018 is positioned between the mouthpiece fastener 1012 and the external mouthpiece mounting threads 1021 of the vaporizer assembly 102.

In certain embodiments, the vaporizer assembly 102 includes a heating element assembly 104. The heating element assembly 104 is installed on a heating element base 1045. The heating element assembly 104 includes an E-liquid storage tank internal wall 1041 defining multiple E-liquid openings. In an exemplary embodiment as shown in FIG. 4, the E-liquid storage tank internal wall 1041 defines a first E-liquid opening 10411, a second E-liquid opening 10412, and a third E-liquid opening 10413 (not shown in FIG. 4). These E-liquid openings allow an external E-liquid storage medium 1044 positioned inside of the E-liquid storage tank internal wall 1041, and an internal E-liquid storage medium 1042 positioned inside of the external E-liquid storage medium 1044 to receive E-liquid from the E-liquid storage tank 111. The heating element assembly 104 may also include multiple heating elements 1043. In one embodiment, the heating element assembly 104 may include N heating elements 1043, as shown in FIG. 6. In an exemplary embodiment shown in FIG. 4, the multiple heating elements 1043 include a first heating element 10431, a second heating element 10432, and a third heating element 10433. These heating elements 1043 are in direct contact with surface of the internal E-liquid storage medium 1042 to heat the E-liquid received from the E-liquid storage tank 111. Each of the first heating element 10431, the second heating element 10432, and the third heating element 10433 can be turned on by a user of the electronic cigarette 10 individually. The user may switch on one or more of the heating elements 1043 to adjust the vaporization of the E-liquid by the vaporizer assembly 102.

In certain embodiments, the E-liquid storage tank 111 is installed outside of the vaporizer assembly 102. The E-liquid storage tank 111 includes: an E-liquid storage tank top cover 1013 on the top end of the E-liquid storage tank 111, the E-liquid storage tank internal wall 1041 from the inside of the E-liquid storage tank 111, an E-liquid storage tank external wall 1022 forming the outside of the E-liquid storage tank 111, and a vaporizer assembly mounting base 1024 at the bottom of the E-liquid storage tank 111. The E-liquid storage tank 111 is sealed by a first mouthpiece sealing ring 1014 on the top and a vaporizer sealing ring 1023 at the bottom.

In certain embodiments, the electronic cigarette 10 includes a printed circuit board 1031 as shown in FIG. 3. The printed circuit board 1031 is in a circular shape to allow air to flow through the center. The printed circuit board 1031 forms an electronic circuit for the electronic cigarette 10 as shown in FIG. 6. The electronic circuit shown in FIG. 6 includes N heating elements 10431, 10432, . . . , and 1043N, N push button switches 10341, 10342, . . . , and 1034N, and N display circuits. Here, N is a positive integer, and the electronic circuit includes one push button switch, one switching terminal, and one output terminal for each of the heating elements 1043.

The printed circuit board 1031 includes: a positive terminal VCC, a negative terminal or ground of the electrical power supply as shown in FIG. 6, N switching terminals connecting to the positive terminal VCC to each of N push button switches, and N output terminal connecting each of N push button switches to each of the heating elements 10431, 10432, . . . , and 1043N, respectively. The positive terminal of the printed circuit board 1031 is electrically coupled to a positive terminal 1037 of the electrical power supply. Each of push button switches is used to provide electrical power control to a corresponding heating element. The negative terminal of the printed circuit board 1031 is electrically coupled to a negative terminal 1035 of the electrical power supply. The positive terminal 1037 and the negative terminal 1035 are isolated by a positive terminal isolation ring 1036. As shown in FIG. 3, the printed circuit board 1031 is installed on a switch mounting ring 1033 with several PCB fasteners 1032. A silicone gel cover 1027 is installed on the top of the printed circuit board 1031 to prevent any liquid or E-liquid to contact the printed circuit board 1031.

In certain embodiments, each of the heating elements 1043 has a positive terminal and a negative terminal. The positive terminal of the heating element is electrically coupled to a positive terminal 1037 of an electrical power supply through a push button switch in serial, and the negative terminal of the heating element is electrically coupled to the negative terminal 1035. As shown in FIG. 4, the vaporizer assembly 102 includes three heating elements: a first heating element 10431, a second heating element 10432, and a third heating element 10433. The first heating element 10431 is connected to the positive terminal 1037 through a first positive terminal 10471. The second heating element 10432 is connected to the positive terminal 1037 through a second positive terminal 10481. The third heating element 10433 is connected to the positive terminal 1037 through a third positive terminal 10491.

The negative terminals of the heating elements 1043 are connected to the body of the electronic cigarette 10, which connects to the negative terminal 1035 of the electrical power supply. A first positive terminal isolation ring 10472 is used to isolate the first positive terminal 10471 and the heating element base 1045. The heating element base 1045 includes a heating element base screw 10451 and the heating element base screw 10451 is used to connect the heating element base 1045 to the vaporizer assembly mounting base 1024, as shown in FIG. 5. A second positive terminal isolation ring 10482 is used to isolate the first positive terminal 10471 and the second positive terminal 10481. A third positive terminal isolation ring 10492 is used to isolate the third positive terminal 10491 and the second positive terminal 10481. A heating element sealing ring 1046 seals the vaporizer assembly 102 and the electronic cigarette base assembly 103 to prevent the E-liquid in the vaporizer assembly 102 from leaking into the electronic cigarette base assembly 103.

In certain embodiments, each display circuit is used for each of the heating elements 1043 to indicate whether the corresponding heating element is powered up and in use. Each of the display circuits has a resistor and a light emitting diode (LED). The resister and the LED are connected in serial. A first terminal of the resistor forms a first terminal of the corresponding display circuit. A second terminal of the resistor is connected to the anode of the LED. The cathode of the LED forms a second terminal of the corresponding display circuit. The first terminal of the corresponding display circuit is electrically coupled to the corresponding output terminal of the printed circuit board 1031, and the second terminal of the corresponding display circuit is electrically coupled to the negative terminal of the printed circuit board 1031 and the negative terminal 1035 of the electronic cigarette 10. For example, a first display circuit includes a resistor R1 and a light emit diode (LED) D1 connected in serial, and the first display circuit is parallelly connected to the first heating element 10431. Other display circuits are connected to their corresponding heating elements in similar manner. Each of the LEDs may be incorporated into its corresponding push button switch. In one embodiment, each of the push button switches may include a hole to install an LED. In another embodiment, perimeter of the push button switch may be surrounded with transparent materials to show light of the LEDs.

In certain embodiments, each push button switch has a first terminal electrically coupled to a corresponding switching terminal, and a second terminal electrically coupled to a corresponding output terminal and the positive terminal of a corresponding heating element, and the negative terminal of the corresponding heating element is electrically coupled to the negative terminal of the printed circuit board 1031 and the negative terminal 1035 of the electrical power supply.

In certain embodiments, the electronic cigarette base assembly 103 includes: a switch mounting ring 1033, an air chamber body 1026, and an air intake adjustment ring 1025. The switch mounting ring 1033 is mounted at a bottom end of the vaporizer assembly mounting base 1024. The multiple push button switches are installed on the switch mounting ring 1033. The air chamber body 1026 defines a first air chamber opening 10261 and a second air chamber opening 10262. The air chamber body 1026 is positioned between the vaporizer assembly mounting base 1024 and the switch mounting ring 1033 to form an air chamber. The air intake adjustment ring 1025 is rotatably installed outside of the air chamber body 1026. The air intake adjustment ring 1025 defines a first air intake opening 10251 and a second air intake opening 10252. The user may rotate the air intake adjustment ring 1025 to adjust air intake to coincide the first air chamber opening 10261 and the second air chamber opening 10262, respectively. Each of the switch mounting ring 1033, the vaporizer assembly mounting base 1024, the air chamber body 1026, and the air intake adjustment ring 1025 is in a ring shape to form the air chamber in the center of the air chamber body 1026.

Figure 7:
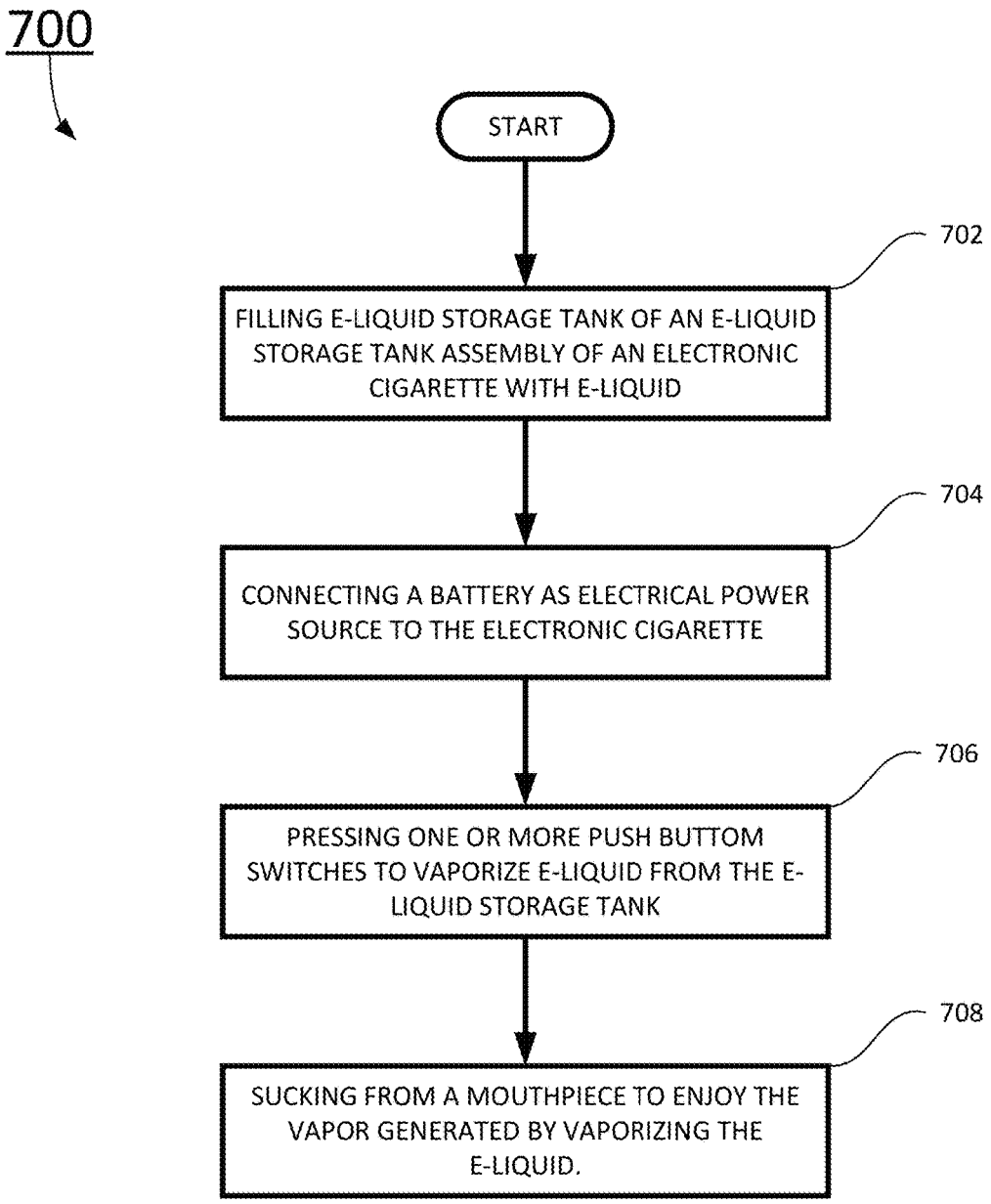
FIG. 7 is a flow chart of an exemplary method of using the electronic cigarette having the vaporizer with multiple heating elements according to certain embodiments of the present disclosure.

In yet another aspect, the present disclosure relates to a method 700 of using an electronic cigarette 10 having a vaporizer assembly 102 with multiple heating elements 1043, as shown in FIG. 7.

At block 702, a user of the electronic cigarette 10 may filling an E-liquid storage tank 111 of a vaporizer assembly 102 of the electronic cigarette 10 with E-liquid. In one embodiment, the E-liquid storage tank 111 is a refillable E-liquid storage tank. An E-liquid storage tank top cover 1013 of a mouthpiece assembly 101 may be removed and E-liquid may be filled into the E-liquid storage tank 111 between the E-liquid storage tank external wall 1022 and the E-liquid storage tank internal wall 1041. In certain embodiments, the E-liquid storage tank 111 is not refillable, and the E-liquid storage tank 111 has already been filled with adequate E-liquid.

At block 704, the user may connect an electrical power supply to the electronic cigarette 10. The electronic cigarette 10 has a positive terminal 1037 and a negative terminal 1035. The electrical power supply may include a battery or a rechargeable battery. The electrical power supply is connected to the positive terminal 1037 and the negative terminal 1035 of the electronic cigarette 10 through one of: a T-shaped groove connector, a dovetail shaped slot connector, a magnetic attachment connector, a threaded connector, and a multi-threaded connector. In certain embodiments, as shown in FIGS. 1, 2 and 5, the electrical power supply is connected to the electronic cigarette 10 through a threaded connector, or a multi-threaded connector.

At block 706, the user presses one or more push button switches to turn on the electrical power supply connected to one or more heating elements 1043 according to the desired amount vapor the user wishes to have, one push button switch corresponds to one heating element.

At block 708, the user sucks E-liquid vapor from the vaporizer assembly 102 through a mouthpiece 1011. Air outside of the electronic cigarette 10 enters the vaporizer assembly 102 through an air intake adjustment ring 1025. The air intake adjustment ring 1025 defines a first air intake opening 10251 and a second air intake opening 10252. The air intake adjustment ring 1025 is rotatably positioned outside of an air chamber body 1026. The air chamber body 1026 defines a first air chamber opening 10261 and a second air chamber opening 10262. The user may rotate the air intake adjustment ring 1025 to adjust the air intake to the air chamber body 1026. In one embodiment, the air intake adjustment ring 1025 is adjusted to a maximum position so that the first air intake opening 10251 and the second air intake opening 10252 coincide the first air chamber opening 10261 and the second air chamber opening 10262 of the air chamber body 1026, respectively to allow maximum air flow into the air chamber body 1026. In another embodiment, the air intake adjustment ring 1025 is adjusted to a minimum position so that the first air intake opening 10251 and the second air intake opening 10252 overlaps the first air chamber opening 10261 and the second air chamber opening 10262 of the air chamber body 1026 partially to reduce the air intake to the air chamber body 1026 to its minimum. The air in the air chamber body 1026 is vaporized by the vaporizer assembly 102, and vapor formed by the vaporizer assembly 102 exits through the mouthpiece 1011.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to activate others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims, the foregoing description and the exemplary embodiments described therein, and accompanying drawings.

What is claimed is:

1. A vaporizer assembly, comprising:

a heating element assembly, wherein the heating element assembly comprises:

an E-liquid storage tank of an electronic cigarette for storing E-liquid for the electronic cigarette and supplying the stored E-liquid to the heating assembly, wherein the E-liquid storage tank comprises an E-liquid storage tank external wall and an E-liquid storage tank internal wall defining a plurality of E-liquid openings to allow an external E-liquid storage medium, and an internal E-liquid storage medium to receive the E-liquid stored in the E-liquid storage tank; and a plurality of heating elements in direct contact with surface of the internal E-liquid storage medium to heat the E-liquid received from the E-liquid storage tank, wherein a user of the electronic cigarette switches on one or more of the plurality of the heating elements to adjust the vaporization of the E-liquid.

2. The vaporizer assembly of claim 1, wherein the E-liquid storage tank comprises:

an E-liquid storage tank top cover;

the E-liquid storage tank internal wall;

the E-liquid storage tank external wall; and a vaporizer assembly mounting base, wherein the E-liquid storage tank external wall is positioned outside of the E-liquid storage tank internal wall to form horizontal boundary of the E-liquid storage tank, the E-liquid storage tank top cover is placed on top of the E-liquid storage tank external wall and the E-liquid storage tank internal wall to form top boundary of the E-liquid storage tank and is sealed by a first mouthpiece sealing ring, and the vaporizer assembly mounting base is placed at bottom of the E-liquid storage tank external wall and the E-liquid storage tank internal wall to form bottom boundary of the E-liquid storage tank and is sealed by a vaporizer sealing ring at the bottom of the E-liquid storage tank.

3. The vaporizer assembly of claim 1, wherein each of the plurality of heating elements comprises a positive terminal and a negative terminal, wherein the positive terminal of the heating element is electrically coupled to a positive terminal of an electrical power supply through a push button switch in serial, and the negative terminal of the heating element is electrically coupled to a negative terminal of the electrical power supply through a power supply connector.

4. The vaporizer assembly of claim 3, wherein each of the plurality of heating elements includes a display circuit, wherein each of the display circuit comprises a resistor and a light emitting diode connected in serial to indicate whether the heating element parallelly connected to the display circuit is powered up and in use.

5. The vaporizer assembly of claim 1, wherein the plurality of heating elements comprises:

aluminum (Al);

Chromium (Cr);

Manganese (Mn);

Iron (Fe);

Cobalt (Co);

Nickel (Ni);

Copper (Cu);

Zirconium (Zr);

Niobium (Nb);

Molybdenur (Mo);

Rhenium (Re);

Silver (Ag);

Cadmium (Cd);

Tantalum (Ta);

Tungsten (W);

Iridium (Ir);

Platinum (Pt);

Gold (Au); and alloys thereof.

6. The vaporizer assembly of claim 1, wherein each of the plurality of heating elements comprises:

a grid shaped heating element;

a mesh shaped heating element;

a net shaped heating element;
a spiral heating element; and
any combination thereof.

7. The vaporizer assembly of claim 1, wherein each of the external E-liquid storage medium and the internal E-liquid storage medium comprises:
cotton fibers;
polypropylene fibers;
terylene fibers;
nylon fibers; and
various porous ceramic materials.

8. An electronic cigarette comprising the vaporizer assembly of claim 1.

9. An electronic cigarette comprising:
a mouthpiece assembly for a user to use the electronic cigarette;
an electrical power supply to power the electronic cigarette; and
a vaporizer assembly having a heating element assembly, wherein the heating element assembly comprises:
an E-liquid storage tank of an electronic cigarette for storing E-liquid for the electronic cigarette and supplying the stored E-liquid to the heating assembly, wherein the E-liquid storage tank comprises an E-liquid storage tank external wall and an E-liquid storage tank internal wall defining a plurality of E-liquid openings to allow an external E-liquid storage medium, and an internal E-liquid storage medium to receive E-liquid from the E-liquid storage tank; and
a heating element assembly having a plurality of heating elements in direct contact with surface of the internal E-liquid storage medium to heat the E-liquid received from the E-liquid storage tank, wherein the user switches on one or more of the plurality of the heating elements to adjust the vaporization of the E-liquid.

10. The electronic cigarette of claim 9, wherein the E-liquid storage tank comprises:
an E-liquid storage tank top cover;
the E-liquid storage tank internal wall;
an E-liquid storage tank external wall; and
a vaporizer assembly mounting base,
wherein the E-liquid storage tank external wall is positioned outside of the E-liquid storage tank internal wall to form horizontal boundary of the E-liquid storage tank, the E-liquid storage tank top cover is placed on top of the E-liquid storage tank external wall and the E-liquid storage tank internal wall to form top boundary of the E-liquid storage tank and is sealed by a first mouthpiece sealing ring, and the vaporizer assembly mounting base is placed at bottom of the E-liquid storage tank external wall and the E-liquid storage tank internal wall to form bottom boundary of the E-liquid storage tank and is sealed by a vaporizer sealing ring at the bottom of the E-liquid storage tank.

11. The electronic cigarette of claim 10, wherein the mouthpiece assembly comprises:
a mouthpiece for user to enjoy vaporized E-liquid;
a mouthpiece fastener positioned coaxially inside the mouthpiece to form an internal vapor pathway;
the E-liquid storage tank top cover, wherein the E-liquid storage tank top cover is in a ring shape to cover a top end of the E-liquid storage tank and is sealed by the first mouthpiece sealing ring;
a threaded mouthpiece mounting ring having internal threads to mount the mouthpiece assembly on the vaporizer assembly through an external mouthpiece mounting threads of the vaporizer assembly;
a second mouthpiece sealing ring to block vapor passage between the mouthpiece and the threaded mouthpiece mounting ring having internal threads; and
a third mouthpiece sealing ring positioned between the mouthpiece fastener and the external mouthpiece mounting threads.

12. The electronic cigarette of claim 9, wherein each of the plurality of heating elements comprises a positive terminal and a negative terminal, wherein the positive terminal of the heating element is electrically coupled to a positive terminal of an electrical power supply through a push button switch in serial, and the negative terminal of the heating element is electrically coupled to a negative terminal of the electrical power supply through a power supply connector.

13. The electronic cigarette of claim 12, further comprising a printed circuit board having:
a positive terminal electrically coupled to the positive terminal of the electrical power supply;
a negative terminal electrically coupled to the negative terminal of the electrical power supply;
a plurality of switching terminals, one for each of the plurality of heating elements; and
a plurality of output terminals, one for each of the plurality of heating elements,
wherein each push button switch has a first terminal electrically coupled to a corresponding switching terminal, and a second terminal electrically coupled to a corresponding output terminal and the positive terminal of a corresponding heating element, and the negative terminal of the corresponding heating element is electrically coupled to the negative terminal of the printed circuit board and the negative terminal of the electrical power supply.

14. The electronic cigarette of claim 13, further comprising a plurality of display circuits, one for each of the plurality of heating elements to indicate whether the corresponding heating element is powered up and in use, wherein each of the plurality of display circuits comprises a resistor and a light emitting diode (LED), a first terminal of the resistor forms a first terminal of the corresponding display circuit, a second terminal of the resistor is connected to the anode of the LED, and the cathode of the LED forms a second terminal of the corresponding display circuit, the first terminal of the corresponding display circuit is electrically coupled to the corresponding output terminal of the printed circuit board, and the second terminal of the corresponding display circuit is electrically coupled to the negative terminal of the printed circuit board and the negative terminal of the electronic cigarette.

15. The electronic cigarette of claim 13, further comprising an electronic cigarette base assembly having:
a switch mounting ring mounted at a bottom end of the vaporizer assembly mounting base, wherein a plurality of push button switches is installed on the switch mounting ring;
an air chamber body defining a first air chamber opening, and a second air chamber opening, wherein the air chamber body is positioned between the vaporizer assembly mounting base and the switch mounting ring to form an air chamber;
an air intake adjustment ring defining a first air intake opening and a second air intake opening to adjust air intake by rotating the air intake adjustment ring to coincide the first air chamber opening and the second air chamber opening, respectively,
wherein each of the switch mounting ring, the vaporizer assembly mounting base, the air chamber body, and the air intake adjustment ring is in a ring shape to form the air chamber in the center of the air chamber body.

16. The electronic cigarette of claim 9, wherein the plurality of heating elements comprises:

aluminum (Al);
Chromium (Cr);
Manganese (Mn);
Iron (Fe);
Cobalt (Co);
Nickel (Ni);
Copper (Cu);
Zirconium (Zr);
Niobium (Nb);
Molybdenur (Mo);
Rhenium (Re);
Silver (Ag);
Cadmium (Cd);
Tantalum (Ta);
Tungsten (W);
Iridium (Ir);
Platinum (Pt);
Gold (Au); and
alloys thereof.

17. The electronic cigarette of claim 9, wherein each of the plurality of heating elements comprises:

a grid shaped heating element;
a mesh shaped heating element;
a net shaped heating element;
a spiral heating element; and
any combination thereof.

18. The electronic cigarette of claim 9, wherein each of the external E-liquid storage medium and the internal E-liquid storage medium comprises:

cotton fibers;
polypropylene fibers;
terylene fibers;
nylon fibers; and
porous ceramic materials.

19. A method of using an electronic cigarette having a vaporizer assembly with a plurality of heating elements, comprising:

pressing, by a user, one or more push button switches to turn on an electrical power supply to one or more heating elements according to the desired amount vapor the user wishes to have, wherein one push button switch corresponds to one of the plurality of heating elements; and sucking, by the user, E-liquid vapor from the vaporizer assembly through a mouthpiece, wherein air outside of the electronic cigarette enters the vaporizer assembly through an air intake adjustment ring of the electronic cigarette rotatably installed outside of an air chamber body defining a first air chamber opening and a second air chamber opening, wherein the air intake adjustment ring defines a first air intake opening and a second air intake opening that coincide the first air chamber opening and a second air chamber opening on the air chamber body in the vaporizer, respectively, the amount of air entering the vaporizer assembly is adjusted by turning the air intake adjustment ring and vapor formed by the vaporizer assembly exits through the mouthpiece.

20. The method of claim 19, further comprising one or more of:

filling, by the user, E-liquid into an E-liquid storage tank; and connecting, by the user, the electrical power supply to a positive terminal and a negative terminal of the electronic cigarette, wherein the electrical power supply comprises a battery, or a rechargeable battery, and the electrical power supply is connected to the positive terminal and the negative terminal of the electronic cigarette through a threaded electrical connector.

* * * * *